US008070030B2

(12) United States Patent
Marik

(10) Patent No.: US 8,070,030 B2
(45) **Date of Patent: *Dec. 6, 2011**

(54) BACKPACK ACCESSIBLE FROM THE USER'S FRONT WHILE WEARING

(76) Inventor: Libor Marik, Cimelice (CZ)

( * ) Notice: Subject to any disclaimer, the term of this patent is extended or adjusted under 35 U.S.C. 154(b) by 784 days.

This patent is subject to a terminal disclaimer.

(21) Appl. No.: 11/573,554

(22) PCT Filed: Aug. 27, 2005

(86) PCT No.: PCT/IB2005/052812

§ 371 (c)(1),
(2), (4) Date: Feb. 10, 2007

(87) PCT Pub. No.: WO2006/025011

PCT Pub. Date: Mar. 9, 2006

(65) Prior Publication Data

US 2007/0246499 A1 Oct. 25, 2007

(51) Int. Cl.
*A45F 3/04* (2006.01)

(52) U.S. Cl. ..... 224/624; 224/579; 224/581; 224/647; 224/648

(58) Field of Classification Search ..... 224/604, 224/623–624, 639, 646–647, 197, 578, 581
See application file for complete search history.

(56) References Cited

U.S. PATENT DOCUMENTS

| | | | | |
|---|---|---|---|---|
| 4,114,788 | A | 9/1978 | Zulfich | |
| 5,129,560 | A | 7/1992 | Herman | |
| 5,284,279 | A | 2/1994 | Sason | |
| 5,577,652 | A | 11/1996 | Cooper | |
| 5,660,312 | A | 8/1997 | Suzuki | |
| 5,725,139 | A * | 3/1998 | Smith | 224/637 |
| 5,873,506 | A | 2/1999 | Golling | |
| 5,893,503 | A | 4/1999 | Jean | |
| 5,950,894 | A | 9/1999 | Haber | |
| 6,138,881 | A | 10/2000 | Paul | |
| 6,168,060 | B1 | 1/2001 | Mayers | |
| 6,196,436 | B1 | 3/2001 | Williams | |
| 6,283,350 | B1 | 9/2001 | Gottmeier | |
| 6,311,884 | B1 | 11/2001 | Johnson | |
| 6,382,489 | B2 | 5/2002 | Chuang | |
| 6,394,328 | B1 | 5/2002 | Zakarin | |
| 6,402,003 | B1 | 6/2002 | Jackson | |
| 6,460,746 | B1 | 10/2002 | Amram | |
| 6,530,129 | B1 | 3/2003 | Cheng | |
| 6,592,012 | B2 | 7/2003 | Godshaw | |
| 6,837,409 | B2 | 1/2005 | Lemanski | |
| D507,107 | S | 7/2005 | Goldberg | |

FOREIGN PATENT DOCUMENTS

| | | |
|---|---|---|
| FR | 1992-09005 | 1/1994 |
| WO | WO-94/15496 | 7/1994 |
| WO | WO-2005/027685 | 3/2005 |

* cited by examiner

*Primary Examiner* — Justin Larson
*Assistant Examiner* — John Cogill
(74) *Attorney, Agent, or Firm* — Edwin A. Skoch

(57) ABSTRACT

The present disclosure is an altered backpack with more than one shoulder strap, which allows the wearer to reconfigure the shoulder straps while wearing, swing the backpack around to the wearer's front, and access the contents of the backpack, while still wearing the backpack.

2 Claims, 2 Drawing Sheets

BACKPACK ACCESSIBLE FROM THE USER'S FRONT WHILE WEARING

BACKGROUND

1. Technical Field

The subject disclosure relates generally to backpacks for hiking, camping, or carrying cameras, school paraphernalia, or other equipment.

2. Background

The typical backpack is a bag with a closure and two shoulder straps, which are slung over the shoulders so that the weight of the backpack is distributed on the shoulders and the backpack is carried on the upper back. Each shoulder strap is attached near the upper corner and lower corner of the bag, and each makes a rough loop, between the strap and the bag, through which one of the wearer's arms is stuck. The shoulder straps are typically made from padded material and nylon webbing, to make it more comfortable for the wearer's shoulders to bear the weight of the backpack.

Generally, using two shoulder straps is preferable to slinging the backpack over a single shoulder because the weight load is distributed between two shoulders, making it easier to carry heavy loads for longer periods. Single-shoulder-strap backpacks, such as the common "messenger-bag" style do not offer this, and other, advantages.

The major drawback of using two shoulder straps and carrying the backpack on the back is that the backpack can not be accessed while wearing. That is, accessing the contents of the backpack requires taking at least one shoulder strap off.

BRIEF SUMMARY OF DISCLOSURE

The present disclosure is an improvement to the standard backpack, which allows the wearer to reconfigure the straps while wearing the backpack and to swing the backpack around to the wearer's front and access its contents.

The present disclosure is for a backpack that can be accessed by the wearer, comprising a backpack with a first primary shoulder strap and a second primary shoulder strap; the first primary shoulder strap comprising two segments, the upper segment with one end connected near the top of the backpack and the lower segment with one end connected near the bottom of the backpack, and whose second ends are separably connected together.

This disclosure also includes a method for accessing the contents of a backpack with a plurality of shoulder straps, comprising the steps of disconnecting one shoulder strap; grasping the shoulder strap; lifting the shoulder strap upward; moving the shoulder strap around the wearer's back; and moving the shoulder strap around the wearer's opposite shoulder; and moving the shoulder strap around to the wearer's front; and grasping the backpack; and accessing the contents of the backpack.

Several alterations to the backpack and its straps can be used to create separate embodiments. First, a small handle can be added to the first primary shoulder strap's upper segment.

Second, on the second primary shoulder strap, a secondary shoulder strap can be connected with a first end connected near to the bottom of the second primary shoulder strap and a second end connected nearer to the top of the second primary shoulder strap.

Third, a waist strap or strap around the torso can be separably connected to the second primary shoulder strap by a buckle and connected to the secondary shoulder strap.

Fourth, a bracket and/or snap can be used to hold the second primary and secondary shoulder straps against each other while the backpack is being worn but not being accessed.

Fifth, a bracket, snap, clip, or similar mechanism can be used to temporarily hold the backpack against the wearer's front, while the backpack is being accessed.

Configuring a backpack in this fashion has, at minimum, several advantages over the prior art. First, the backpack can be accessed by the wearer without taking the backpack off. Second, since the present disclosure keeps the backpack "on" the wearer while it is being accessed, it can reduce the possibility of theft of the backpack or its contents. Third, accessing the backpack can be done more simply and in less space, since taking a backpack on and off is often a cumbersome procedure, requiring the wearer to outstretch arms, tilt, bend over, or otherwise contort, while "shrugging off" the shoulder straps, one at a time. This can be of great benefit to wearers in confined conditions, while surrounded by many people or other obstacles, such as on a crowded train. Fourth, it can greatly speed up the process of accessing a backpack's contents. Fifth, unlike a messenger-style backpack with a single shoulder strap, the distribution of weight on the two shoulder straps allows for more comfortable weight carrying.

DETAILED DESCRIPTION

Figure 2:
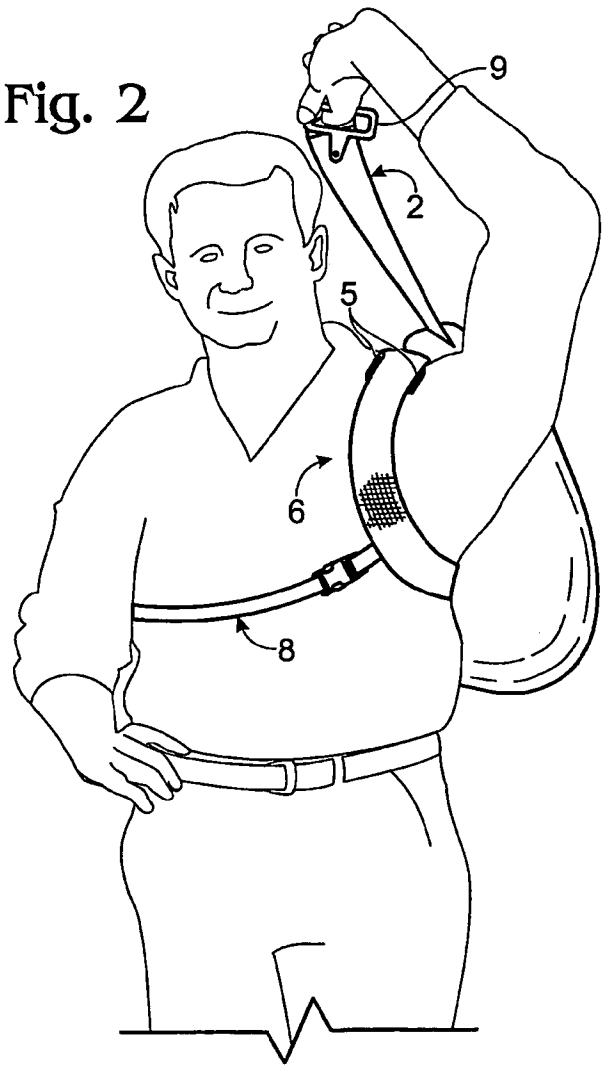
FIG. 2 shows an embodiment of the disclosure in use by a wearer.

Before beginning a detailed description of the subject disclosure, mention of the following is in order. When appropriate, like references and characters are used to designate identical, corresponding, or similar components in different figure drawings. The figure drawings associated with this disclosure are not drawn with strict dimensional accuracy, i.e., such drawings have been drafted with a focus on clarity of viewing and understanding rather than dimensional accuracy.

A typical backpack and its shoulder straps are roughly symmetrical. For simplicity's sake, the figures and the explanation show certain alterations or additions made to one strap or another. These same alterations could be reversed, so that they are made to the other side of the backpack, rather than the one described or shown herein; the present disclosure is not limited to alterations made to one side of the bag or the other. Thus, a "left-handed" or mirror-image version of the same backpack could be made by reversing the changes described.

As described above, a basic backpack typically consists of a bag which can be closed by zipper or otherwise, along with shoulder straps, one for each shoulder, attached at each side of the bag. The shoulder straps are typically padded.

Each shoulder strap is usually made up of two separate pieces: a padded upper segment which is permanently attached to the top of the bag, plus a lower segment which is permanently attached to the bottom of the bag. Typically, the straps are made of two connected segments of woven nylon, connected so that the wearer can adjust the tightness of the shoulder strap but not easily separate the segments. Each shoulder strap, when attached to the bag, roughly forms a loop through which the wearer puts an arm.

In the primary embodiment, the first primary shoulder strap, 1, has an alteration. The two segments of this shoulder strap are connected using a buckle, 10; rather than simply being connected so that the tightness can be adjusted, as with a typical backpack strap. These buckles are commonly used in camping equipment and are well known in the art. A quick-release buckle, while not essential, is preferred. A buckle with a means for adjusting strap length can be used in the present disclosure and is preferred to tighten the shoulder strap against the body while in use, retaining this feature of the typical backpack strap. The buckle allows the wearer to quickly and easily separate, and reconnect, the upper segment, 2, of the first primary shoulder strap, 1, from/to the lower segment, 3, so that the accessing maneuver can be performed.

Connecting the segments of the first primary shoulder strap together can also be accomplished using a snap, clip, or other common mechanisms for connecting straps. Various mechanisms are well known in the field of apparel and sporting goods.

The first primary shoulder strap may have an attached handle, 9, above the buckle that connects the upper, 2, and lower, 3, segments of the first primary shoulder strap. The handle allows the wearer to more easily hold onto the first primary shoulder strap while swinging it around his back during the accessing maneuver.

This embodiment has several preferred alterations to the shoulder strap on the wearer's opposite side (hereinafter the "second primary shoulder strap", 6) as well. First, a secondary shoulder strap, 4, has been added, that slings over the rear of the wearer's shoulder, while the second primary shoulder strap slings over the front of the wearer's shoulder. The second primary shoulder strap and the secondary shoulder strap form a loop, through which the wearer puts his arm, when putting the backpack on. During the accessing maneuver, both second primary shoulder strap and secondary shoulder strap stay slung over the wearer's shoulder. In this fashion, the second primary and secondary shoulder straps operate much like a common pistol shoulder holster.

Figure 1:
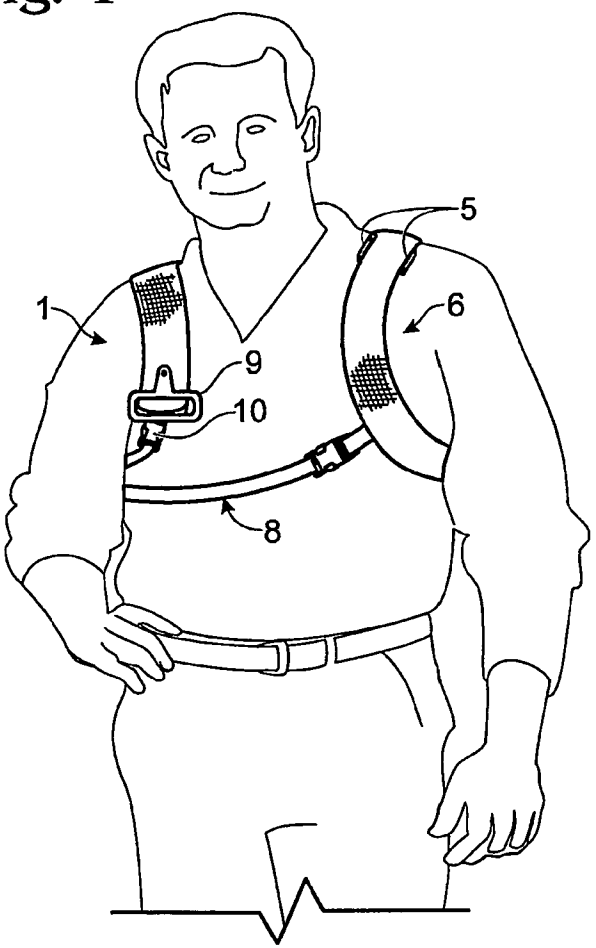
FIG. 1 shows an embodiment of the disclosure in use by a wearer.
Figure 3:
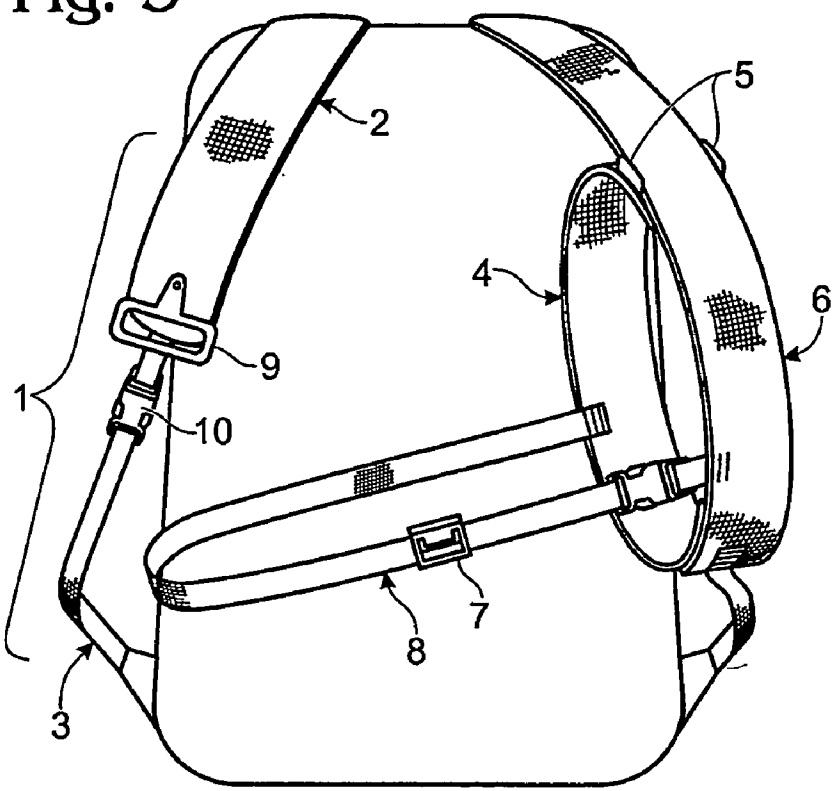
FIG. 3 shows an embodiment of the disclosure, in a front elevation view.

Another preferred alteration to the second primary shoulder strap is the inclusion of a waist strap, 8, which is connected to the secondary shoulder strap (as shown most clearly in FIG. 3) and separably connected to the second primary shoulder strap (as shown in FIGS. 1-3). This waist strap, 8, helps anchor both the second primary and secondary shoulder straps to the wearer's body during the accessing maneuver. The waist strap is preferably adjustable in length. A quick-release buckle is preferred to separably connect the waist strap to the second primary shoulder strap. This strap can go around the waist, chest, or at any height on the torso.

When not in use, the waist strap may be removably connected to the first primary shoulder strap to keep it within easy reach of the wearer, but this is not essential to the disclosure and not shown in the figures.

As shown in figures, the second primary and secondary shoulder straps can be connected to each other on the front of the wearer's shoulder, rather than at the top of the shoulder or at the bag. This allows the bag to swing further forward when accessed. This is most visible in FIG. 4. While not essential, this is preferred.

To further keep the straps stable during wearing, the second primary and secondary shoulder straps can be held aligned parallel and together with a piece of rigid material, a bracket, 5, placed on the front, forward surface of the secondary shoulder strap, to act as a channel within which the second primary shoulder strap can rest. The bracket is preferably a roughly flat piece of rigid material whose left and right edges are bent inward at roughly ninety-degree angles, approximating a roughly square-bracket-shaped ("[") channel that the second primary shoulder strap can rest in. The bracket lessens side-to-side movement of the second primary shoulder strap vis-à-vis the secondary shoulder strap.

Alternatively or additionally, a common snap or clip can be added on the face of the bracket or near it. This is not shown in the figures, but it could be used to lessen side-to-side movement of the second primary shoulder strap vis-à-vis the secondary shoulder strap by holding these two straps against one another when the backpack is being worn but not being accessed.

Figure 4:
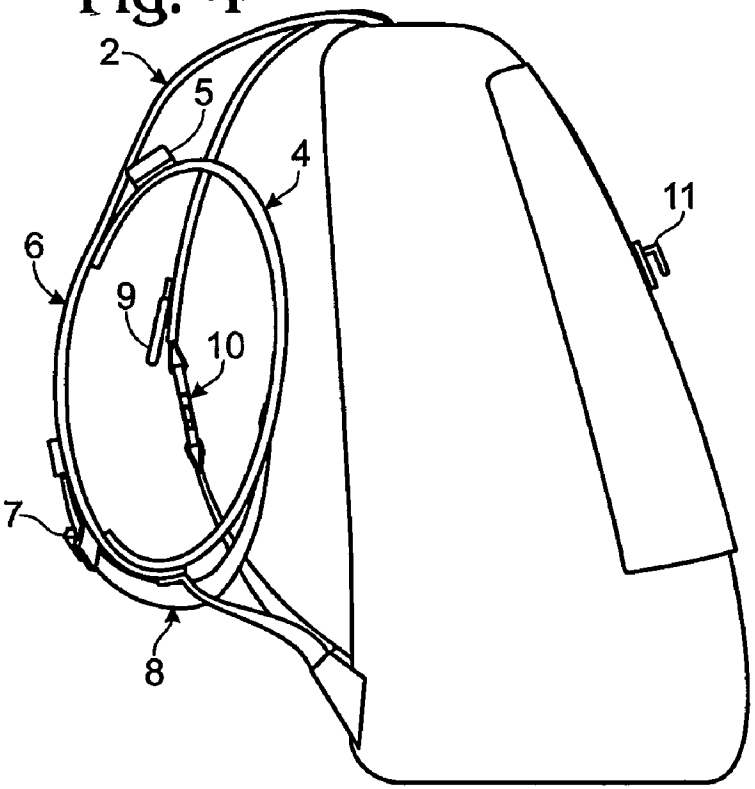
FIG. 4 shows an embodiment of the disclosure, in a side elevation view.

A further non-essential alteration is possible, creating a second embodiment. In order to help hold the backpack against the front of the wearer while the backpack is being accessed, a clip mechanism can be added to the rear of the backpack itself. This is illustrated only in FIGS. 3 and 4. Although not essential, the clip in FIGS. 3 and 4 is show as having a male clip piece, 11, and a female clip piece, 7. (Alternatively, these clip pieces can be reversed.) While the backpack is on the wearer's front, being accessed, the wearer can clip the backpack onto the waist strap, to help hold the backpack against the wearer. Following the suggestion of the figures, the male clip piece would clip into the female clip piece. Two-piece clips of this general nature are common in the apparel and sporting goods industries.

Similarly, a male clip piece, on rear of the backpack, could be used by itself to perform a similar function. Any manner of one-piece clip could be used; for example, those commonly used to clip a mobile phone to a belt. In this fashion, the clip could slide over the waist strap and perform the same function.

Whether a one-piece or two-piece clip is used, the function is approximately the same. When the backpack is being accessed, the rear of the backpack is flipped facing toward the wearer. By affixing a clip to the rear of the backpack, this clip can be temporarily clipped to the waist strap while the backpack is against the wearer's front. Alternatively, the clip on the rear of the backpack could temporarily clip to the wearer's belt. By clipping the backpack to the wearer's front, some of the weight load of the backpack is relieved from the wearer's hands while accessing is performed.

The accessing maneuver for the primary and secondary embodiments works as follows. The wearer puts the waist strap around his waist and buckles the waist strap, 8, to the second primary shoulder strap, 6, as shown in the figures; this is so that the second primary shoulder strap and secondary shoulder strap are connected around the wearer's torso. The wearer then unbuckles the two segments of the first primary shoulder strap and grasps the handle, 9, on the upper segment, 2, of the first primary shoulder strap. The handle can be grasped with either hand. The wearer then swings the first primary shoulder strap around his back, from one side to the other, as illustrated in FIG. 2. The first primary shoulder strap, and then the backpack itself, is brought all the way around to the wearer's front. At this point, the backpack itself can be grasped, opened, and its contents or attachments accessed. It can be held against the wearer's front using the clip described above. This maneuver is reversed to put the backpack into normal carrying position.

Multiple further embodiments can be created by variously eliminating or adding any individual element mentioned above. A third embodiment can be created by eliminating the waist strap. A fourth embodiment could be created by eliminating the secondary shoulder strap. A fifth embodiment could be created by eliminating the bracket on the secondary shoulder strap. A sixth embodiment could be created by omitting the handle from the first primary shoulder strap. Other combinations of elements mentioned can be used to create further embodiments.

I claim:

1. A backpack, comprising:

a. a backpack with a first primary shoulder strap on one side of said backpack and a second primary shoulder strap on the opposite side of said backpack, both connected to said backpack; and, b. said first primary shoulder strap comprising two segments, an upper segment with a first end connected near the top of said backpack and a lower segment with a first end connected near the bottom of said backpack, and whose second ends are separably connected together; and, c. a buckle separably connecting said second ends of said upper and lower segments of said first primary shoulder strap; and, d. said second primary shoulder strap with a first end connected near the top of said backpack on the opposite side of said backpack from said first primary shoulder strap and with a second end connected near the bottom of said backpack on the opposite side of said backpack from said first primary shoulder strap; and, e. a secondary shoulder strap with a first end connected to, and connected near the bottom of, said second primary shoulder strap and a second end connected to, and connected nearer the top of, said second primary shoulder strap; and, f. a waist strap connected to said secondary shoulder strap, separably connected to said second primary shoulder strap; and, g. said upper segment of said first primary shoulder strap can be grasped by a wearer to swing said backpack laterally around the outside of said wearer's shoulder.

2. A backpack, comprising:

a. a backpack with a first primary shoulder strap on one side of said backpack and a second primary shoulder strap on the opposite side of said backpack, both connected to said backpack; and, b. said first primary shoulder strap comprising two segments, an upper segment with a first end connected near the top of said backpack and a lower segment with a first end connected near the bottom of said backpack, and whose second ends are separably connected together; and, c. a buckle separably connecting said second ends of said upper and lower segments of said first primary shoulder strap; and, d. a handle attached near to said second end of said upper segment of said first primary shoulder strap, which a wearer uses to hold onto said first primary shoulder strap to swing said backpack laterally around the outside of said wearer's shoulder; and, e. a second primary shoulder strap with a first end connected near the top of said backpack and with a second end connected near the bottom of said backpack; and, f. a secondary shoulder strap with a first end connected to, and connected near the bottom of, said second primary shoulder strap and a second end connected to, and connected nearer the top of, said second primary shoulder strap; and, g. a waist strap connected to said secondary shoulder strap and separably connected to said second primary shoulder strap; and, h. a buckle separably connecting said waist strap to said second primary shoulder strap; and, i. a rear clip on the rear of said backpack which can be separably connected to the front of said waist strap; and, j. a clip on the front of said waist strap to which said rear clip can be separably connected.

* * * * *